US009267265B1

(12) United States Patent
Pastuch

(10) Patent No.: US 9,267,265 B1
(45) Date of Patent: Feb. 23, 2016

(54) GROUND-LEVELING ATTACHMENT FOR CONSTRUCTION EQUIPMENT

(71) Applicant: Joseph Pastuch, Boswell, PA (US)

(72) Inventor: Joseph Pastuch, Boswell, PA (US)

( * ) Notice: Subject to any disclaimer, the term of this patent is extended or adjusted under 35 U.S.C. 154(b) by 99 days.

(21) Appl. No.: 14/247,584

(22) Filed: Apr. 8, 2014

(51) Int. Cl.
*E02F 3/815* (2006.01)
*E02F 3/96* (2006.01)

(52) U.S. Cl.
CPC ..... *E02F 3/815* (2013.01); *E02F 3/962* (2013.01)

(58) Field of Classification Search
USPC ..... 37/31, 407, 410, 903, 381; 172/719; D15/32
IPC ..... E02F 3/8152,3/962
See application file for complete search history.

(56) References Cited

U.S. PATENT DOCUMENTS 2,868,306 A * 1/1959 Key ..... A01B 31/00 172/200
3,090,141 A * 5/1963 Shumaker ..... E02F 3/841 172/255
4,815,542 A * 3/1989 DePlazes ..... E02F 3/627 172/243
4,819,349 A * 4/1989 Mensch ..... 37/407
5,273,375 A * 12/1993 Plourde ..... 404/118
D358,401 S * 5/1995 Devaney ..... D15/11
5,497,569 A * 3/1996 Byman ..... E02F 3/815 15/245
5,718,295 A * 2/1998 Trahan ..... E02F 3/7622 172/26.5
6,085,848 A * 7/2000 Sanders ..... A01B 31/00 172/197
6,243,975 B1 * 6/2001 Gall ..... 37/407
6,523,619 B1 * 2/2003 Cherry ..... A01B 31/00 172/684.5
6,817,121 B2 * 11/2004 Grgic ..... 37/410
6,918,448 B2 * 7/2005 Smith ..... E02F 3/815 172/684.5
2014/0248111 A1 * 9/2014 Williams et al. ..... 414/724
2014/0317968 A1 * 10/2014 Payne ..... 37/405

* cited by examiner

*Primary Examiner* — Gary Hartmann
(74) *Attorney, Agent, or Firm* — Kyle A. Flecther, Esq.

(57) ABSTRACT

A ground leveling assembly for mounting to a vehicle includes a grading member that may abut Earth. An L-shaped bracket is coupled to the grading member. The L-shaped bracket is operationally coupled to the vehicle. The vehicle urges the grading member along Earth so the grading member grades Earth.

11 Claims, 6 Drawing Sheets

GROUND-LEVELING ATTACHMENT FOR CONSTRUCTION EQUIPMENT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of construction equipment, more specifically, ground leveling attachment for construction equipment.

SUMMARY OF THE INVENTION

An embodiment of the disclosure meets the needs presented above by generally comprising a grading member that may abut Earth. An L-shaped bracket is coupled to the grading member. The L-shaped bracket is operationally coupled to the vehicle. The vehicle urges the grading member along Earth so the grading member grades Earth.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
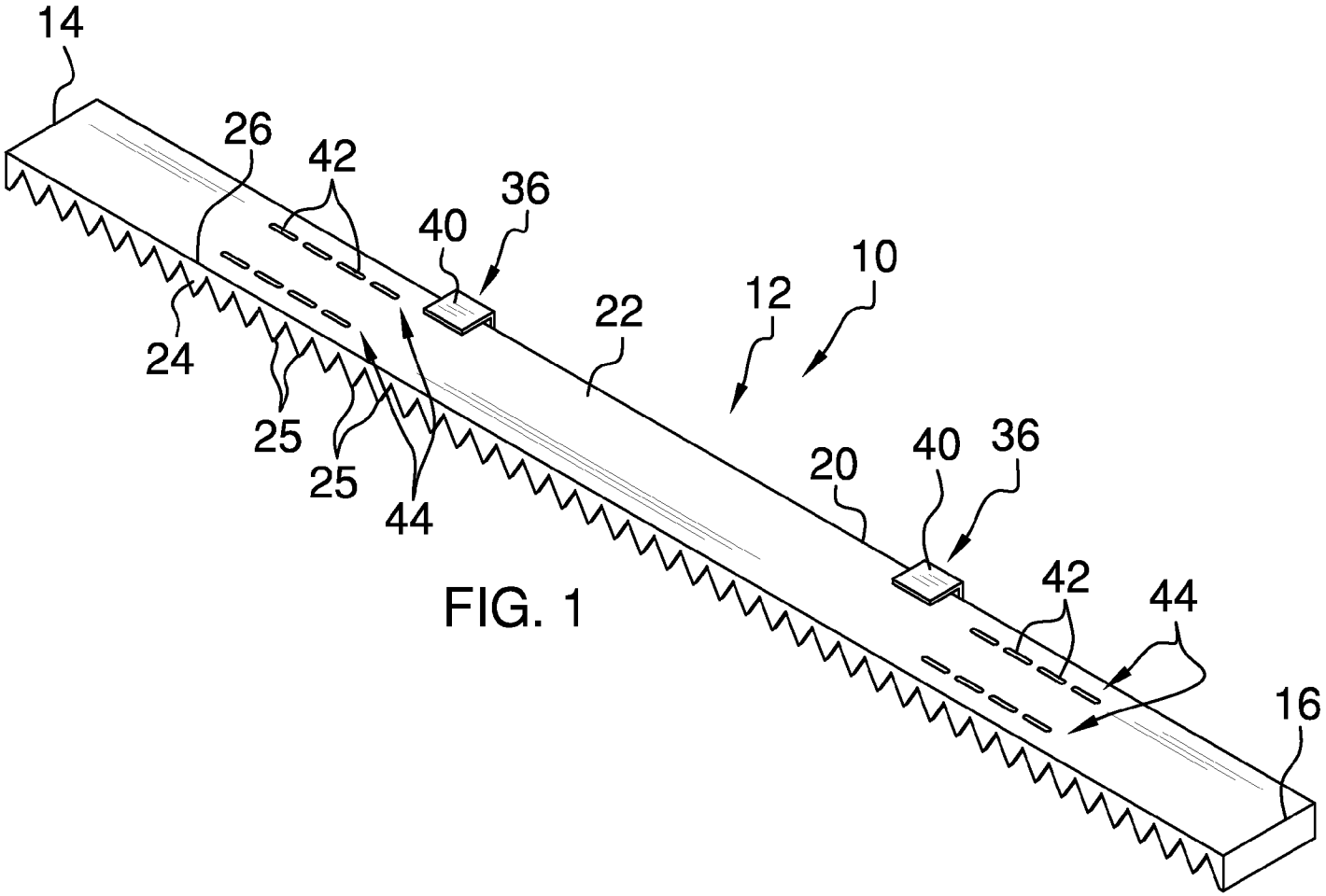
FIG. 1 is a perspective view of a ground leveling assembly according to an embodiment of the disclosure.
Figure 2:
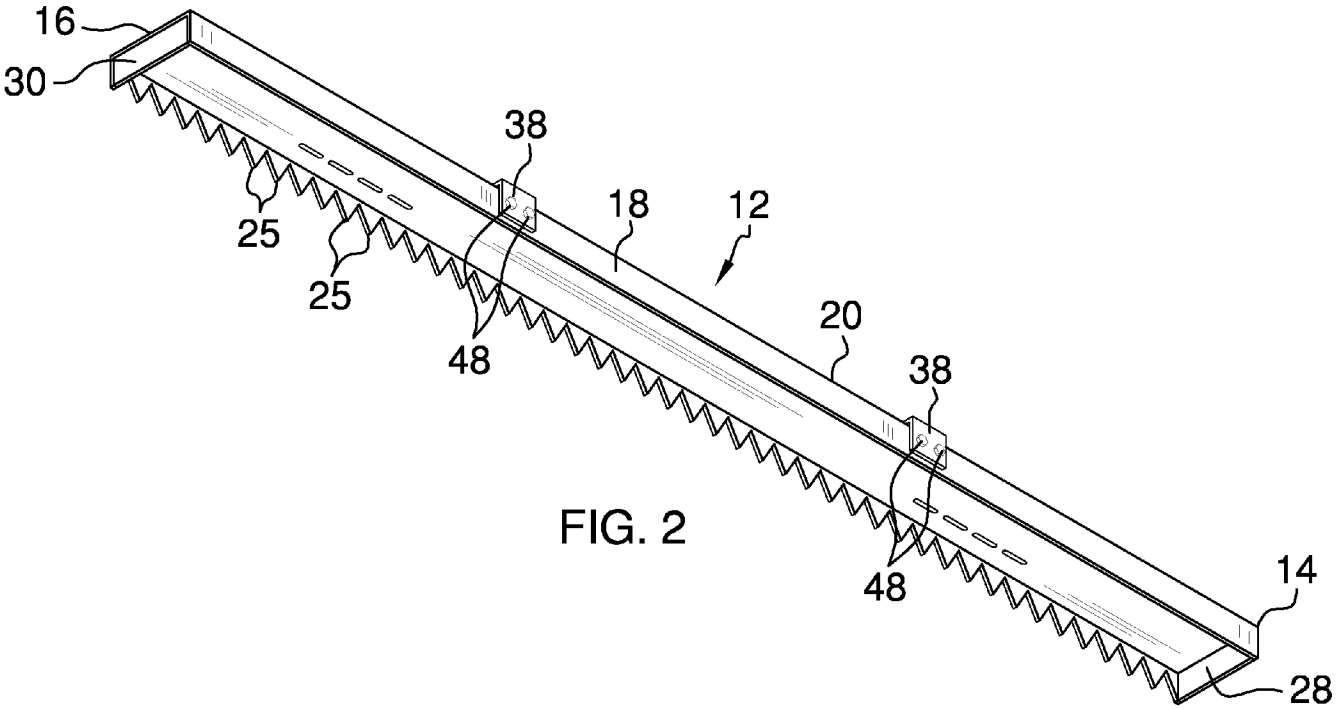
FIG. 2 is a bottom perspective view of an embodiment of the disclosure.
Figure 3:
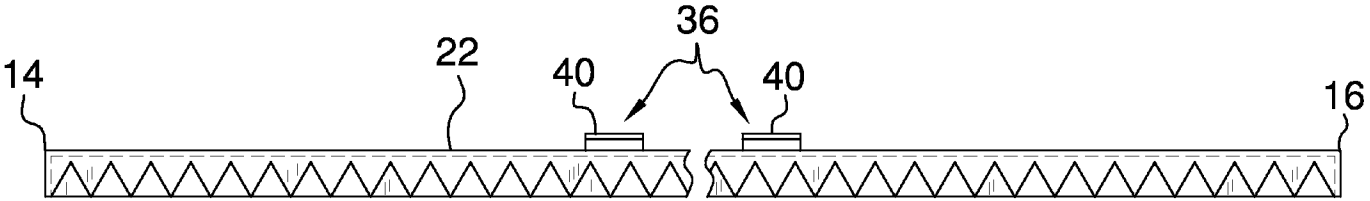
FIG. 3 is a back view of an embodiment of the disclosure.
Figure 4:
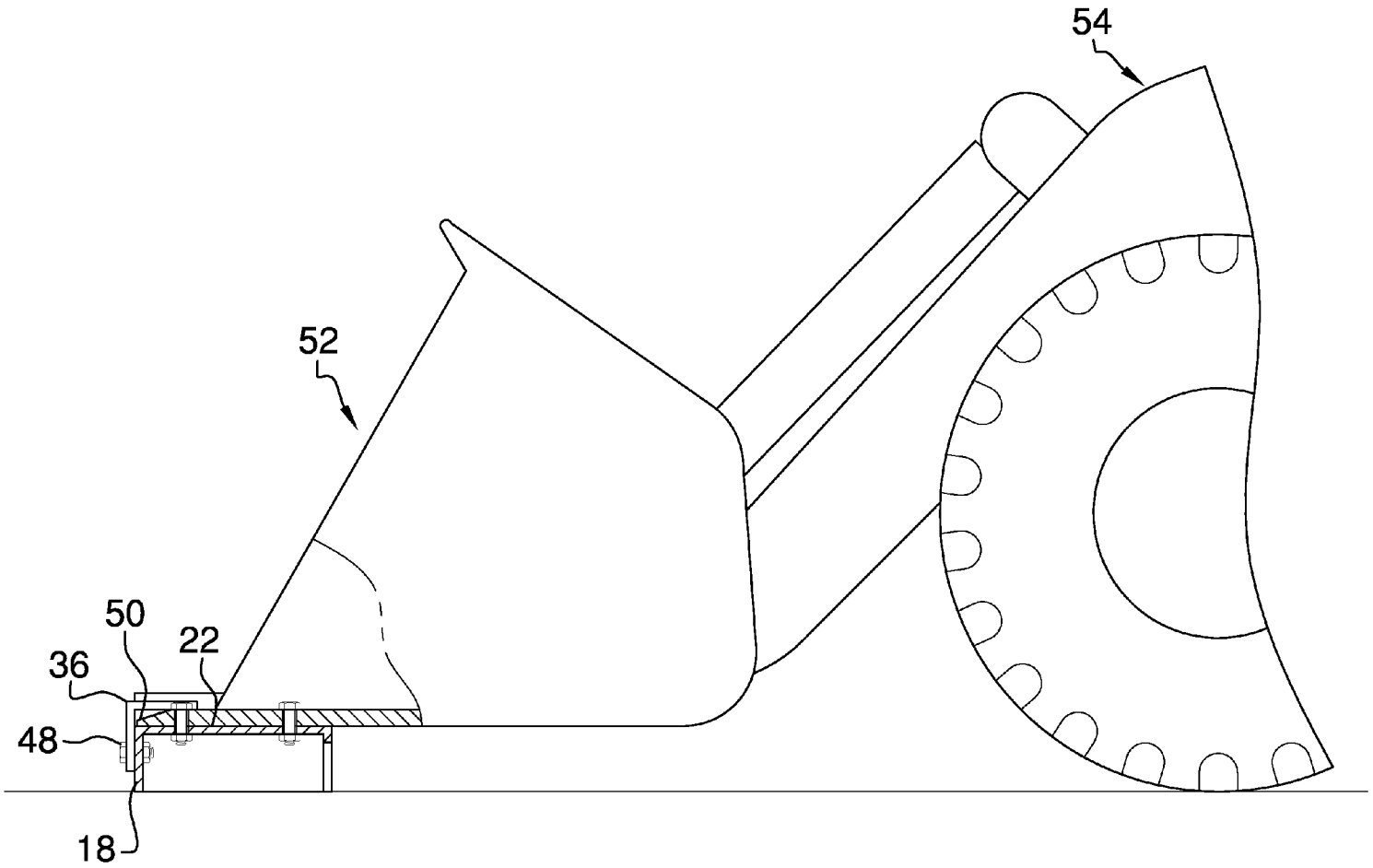
FIG. 4 is an in-use view of an embodiment of the disclosure.
Figure 5:
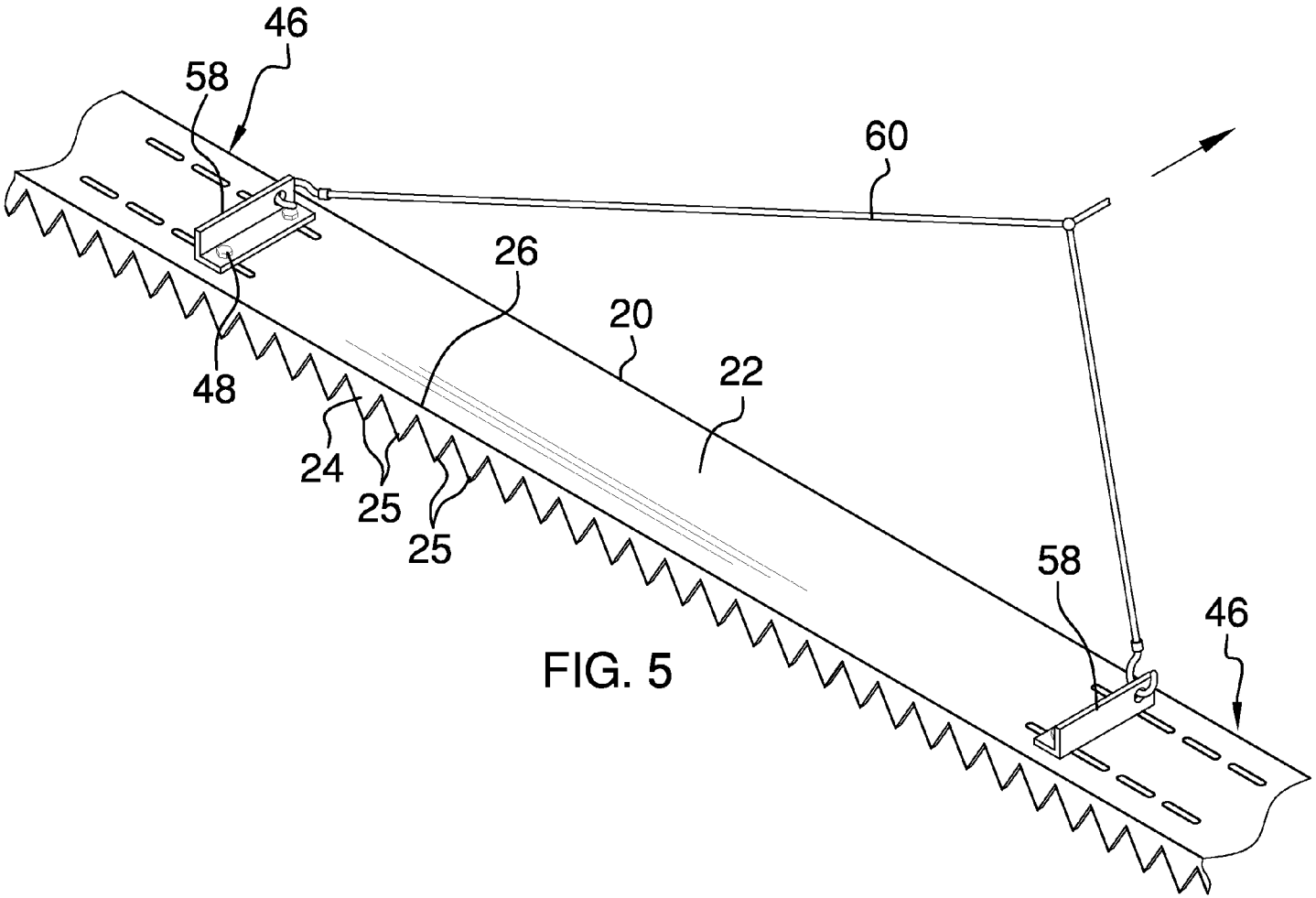
FIG. 5 is a top perspective view of an embodiment of the disclosure.
Figure 6:
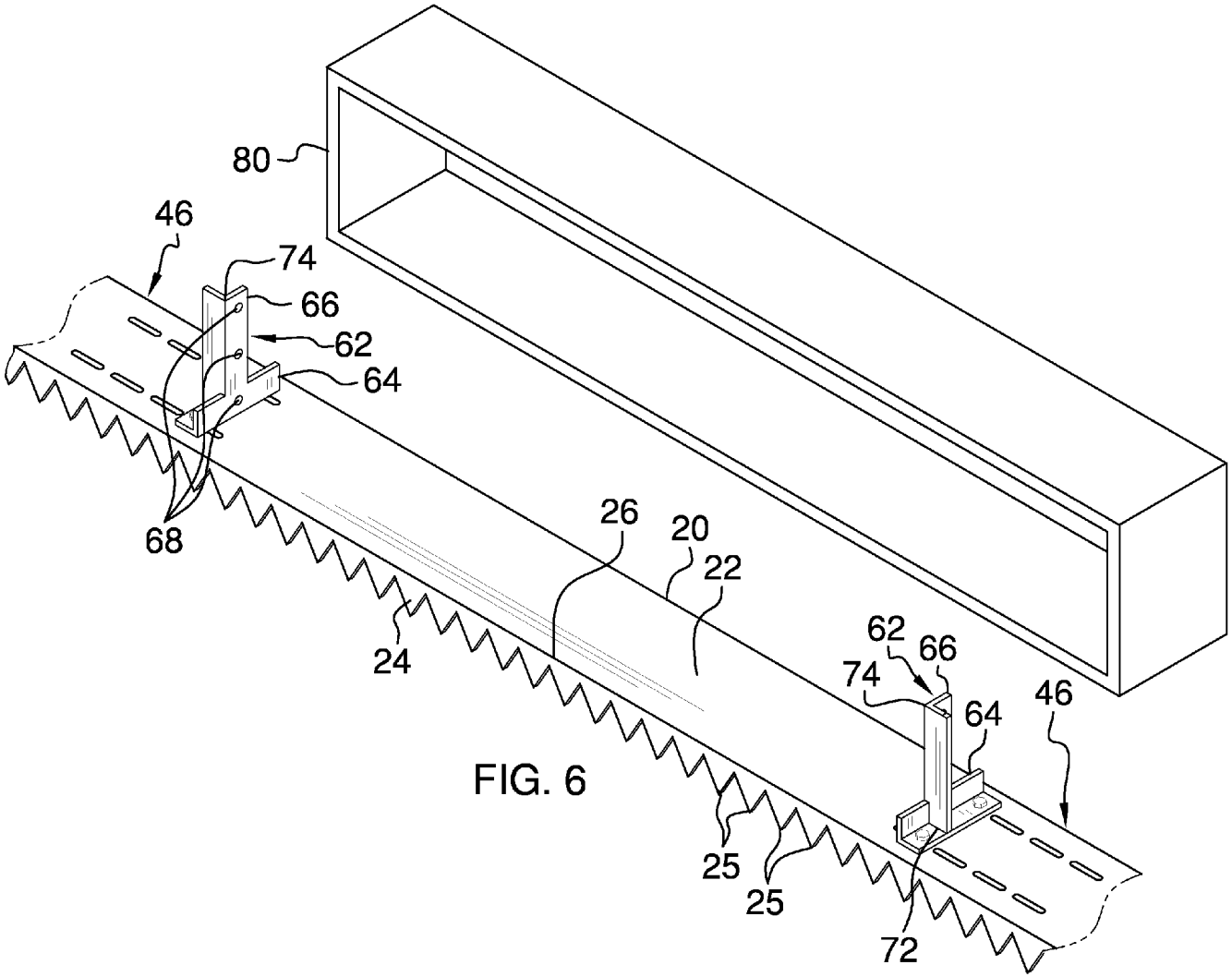
FIG. 6 is a top perspective view of an alternative embodiment of the disclosure.
Figure 7:
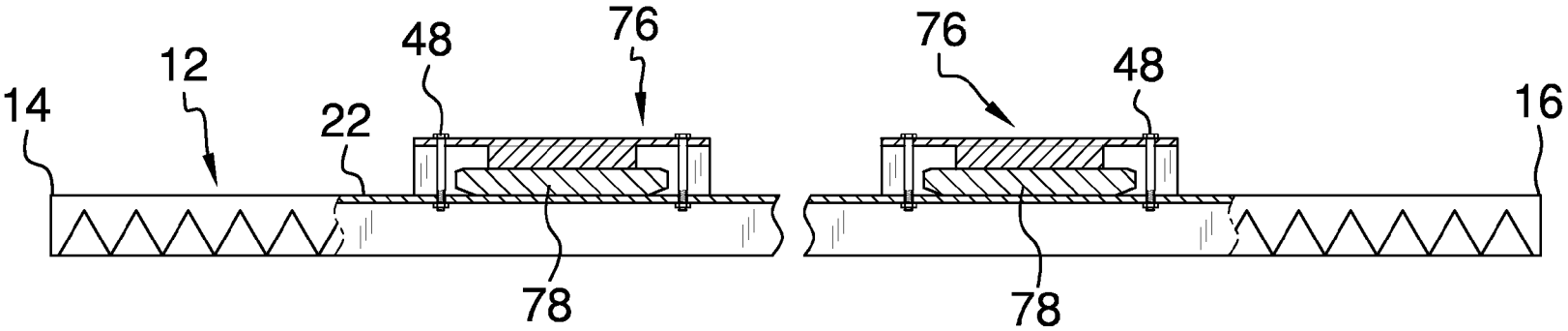
FIG. 7 is a front view of an embodiment of the disclosure.

As best illustrated in FIGS. 1 through 7, the ground leveling assembly 10 (hereinafter assembly) generally comprises a grading member 12 that is elongated along a longitudinal axis extending through a first end 14 and a second end 16 of the grading member 12. The grading member 12 may have a length between 1.5 m and 3 m. Further, the grading member 12 may have a width between 7 cm and 15 cm. Lastly, the grading member 12 may be comprised of a rigid material such as steel or other similar material.

A front side 18 of the grading member 12 is coupled to and extends downwardly from a front edge 20 of a top side 22 of the grading member 12. Additionally, a back side 24 of the grading member 12 is coupled to and extends downwardly from a back edge 26 of the top side 22 of the grading member 12. Each of the front 18 and back 24 sides of the grading member 12 may have a height between 5 cm and 10 cm. Additionally, the back side 24 of the grading member 12 comprises a plurality of teeth 25 that is evenly distributed between the first 14 and second 16 ends of the grading member 12.

A first lateral side 28 of the grading member 12 is coupled to and extends downwardly from the first end 14 of the grading member 12. The first lateral side 28 of the grading member 12 extends between the front 18 and back 24 sides of the grading member 12. Continuing, a second lateral side 30 of the grading member 12 is coupled to and extends downwardly from the second end 16 of the grading member 12. The second lateral side 30 of the grading member 12 extends between the front 18 and back 24 sides of the grading member 12. Lastly, each of the first 28 and second 30 lateral sides of the grading member 12 may have a height between 5 cm and 10 cm.

An L-shaped bracket 36 is coupled to the grading member 12. The L-shaped bracket 36 comprises a vertical portion 38 of the L-shaped bracket 36 that is coupled to the front side 18 of the grading member 12. A horizontal portion 40 of the L-shaped bracket 36 is spaced upwardly from the top side 22 of the grading member 12. Moreover, the horizontal portion 40 of the L-shaped bracket 36 extends toward the back side 24 of the grading member 12. Each of the horizontal 40 and vertical 38 portions of the L-shaped bracket 36 may have a length between 5 cm and 10 cm and a width between 5 cm and 10 cm.

A plurality of fastener apertures 42 extends through the top side 22 of the grading member 12. Further, the plurality of fastener apertures 42 comprises a pair of sets of the plurality of fastener apertures 44. The pair of sets of the plurality of fastener apertures 44 is one of a pair of the pair of sets of the plurality of fastener apertures 46. Each of the pair of the pair of sets of the plurality of fastener apertures 46 is positioned proximate an associated one of the first 14 and second 16 ends of the grading member 12.

A fastener 48 extends through the vertical portion 38 of the L-shaped bracket 36 and engages the front side 18 of the grading member 12. The fastener 48 retains the L-shaped bracket 36 on the grading member 12. Continuing, the fastener 48 is one of a pair of spaced fasteners 48. The fastener 48 may be a nut and bolt of any conventional design. The L-shaped bracket 36 is one of a pair of the L-shaped brackets 36. Each of the pair of L-shaped brackets 36 is positioned proximate an associated one of the first 14 and second 16 ends of the grading member 12.

A front edge 50 of a bucket 52 on a vehicle 54 is selectively positionable between the horizontal portion 40 of the pair of the L-shaped brackets 36 and the top side 22 of the grading member 12. Further, a pair of fasteners 48 extends through the bucket 52 and engages the top side 22 of the grading member 12 so the grading member 12 is retained on the bucket 52. The vehicle 54 urges the grading member 12 along Earth. Continuing, the front side 18 of the grading member 12 abrades Earth so the grading member 12 may level Earth. Lastly, the vehicle 54 may be construction equipment of any conventional design.

An L-shaped drag bracket 58 is provided. The L-shaped drag bracket 58 is selectively coupled to the top side 22 of the grading member 12. Further, the L-shaped drag bracket 58 is one of a pair of L-shaped drag brackets 58. Each of the pair of L-shaped drag brackets 58 is positioned over a selected one of an associated pair of sets of the plurality of fastener apertures 44. A fastener 48 extends through the L-shaped drag bracket 58 and engages the selected fastener apertures 42 so the L-shaped drag bracket 58 is retained on the grading member 12. A drag line 60 is removably coupled to the pair of L-shaped drag brackets 58 so the drag line 60 urges the grading member 12 along Earth.

A snow blower bracket 62 is provided. An L-shaped bottom portion 64 of the snow blower bracket 62 is selectively coupled to the top side 22 of the grading member 12. Additionally, an L-shaped vertical portion 66 of the snow blower bracket 62 is coupled to and extends upwardly from the L-shaped bottom portion 64 of the snow blower bracket 62. A plurality of fastener apertures 68 extends through a first lateral side 70 of the vertical portion 66 of the snow blower bracket 62. Further, the plurality of fastener apertures 68 is evenly distributed between a bottom end 72 and a top end 74 of the vertical portion 66 of the snow blower bracket 62. The snow blower bracket 62 is one of a pair of snow blower brackets 62 each selectively coupled to an associated one of the pair of the pair of sets of the fastener apertures 46 in the top side 22 of the grading member 12.

A U-shaped fork lift bracket 76 is provided. The U-shaped fork lift bracket 76 is coupled to the top side 22 of the grading member 12. Continuing, a pair of fasteners 48 extends through the U-shaped fork lift bracket 76 and engages a selected one of the pair of sets of fastener apertures 44 in the top side 22 of the grading member 12. The U-shaped fork lift bracket 76 is one of a pair of U-shaped fork lift brackets 76 coupled to an associated one of the pair of the pair of sets of fastener apertures 46 in the top side 22 of the grading member 12. Further, the pair of U-shaped fork lift brackets 76 each insertably receives a fork 78 so the grading member 12 is coupled to the fork 78.

In use, the grading member 12 is coupled to the bucket 52, the drag line 60, a snow blower 80 or the fork 78. Further, the vehicle 54 is driven forwardly so the grading member 12 grades Earth. The grading member 12 may be flipped so the plurality of teeth 25 is positioned at the front of the grading member 12. Further, the plurality of teeth 25 rakes Earth so Earth may be graded at a later time. The assembly 10 allows the vehicle 54 to be utilized for construction purposes in addition to the vehicle's 54 intended design.

With respect to the above description, it is to be realized that the optimum dimensional relationship for the various components of the assembly 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the assembly 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A ground leveling assembly for mounting to a vehicle, said assembly comprising:

a grading member configured to abut Earth;

an L-shaped bracket coupled to said grading member, said L-shaped bracket being operationally coupled to the vehicle wherein the vehicle urges said grading member along Earth wherein said grading member grades Earth;

wherein said grading member being elongated along a longitudinal axis extending through a first end and a second end of said grading member;

wherein a front side of said grading member coupled to and extending downwardly from a front edge of a top side of said grading member;

wherein a back side of said grading member comprising a plurality of teeth being evenly distributed between a first end and a second end of said grading member;

wherein a first lateral side of said grading member coupled to and extending downwardly from a first end of said grading member;

wherein said first lateral side of said grading member extends between a front side and a back side of said grading member;

wherein a second lateral side of said grading member coupled to and extending downwardly from a second end of said grading member;

wherein said second lateral side of said grading member extends between a front side and a back side of said grading member.

2. The assembly according to claim 1 wherein a back side of said grading member coupled to and extending downwardly from a back edge of a top side of said grading member.

3. The assembly according to claim 1 wherein a vertical portion of said L-shaped bracket being coupled to a front side of said grading member.

4. The assembly according to claim 3 wherein a horizontal portion of said L-shaped bracket is spaced upwardly from a top side of said grading member wherein said horizontal portion of said L-shaped bracket extends toward a back side of said grading member.

5. The assembly according to claim 1 wherein a fastener extending through a vertical portion of said L-shaped bracket and engaging a front side of said grading member wherein said L-shaped bracket is retained on said grading member.

6. The assembly according to claim 5 wherein said fastener being one of a pair of spaced fasteners.

7. The assembly according to claim 1 wherein said L-shaped bracket being one of a pair of said L-shaped brackets.

8. The assembly according to claim 7 wherein each of said pair of L-shaped brackets being positioned proximate an associated one of a first end and a second end of said grading member.

9. The assembly according to claim 1 wherein a front edge of a bucket on the vehicle being selectively positionable between a horizontal portion of a pair of said L-shaped brackets and a top side of said grading member wherein said grading member is coupled to the bucket on the vehicle.

10. The assembly according to claim 1 wherein said grading member being urged along Earth wherein a front side of said grading member abrades Earth wherein said grading member is configured to level Earth.

11. A ground leveling assembly for mounting to a vehicle, said assembly comprising:

a grading member being elongated along a longitudinal axis extending through a first end and a second end of said grading member;

a front side of said grading member coupled to and extending downwardly from a front edge of a top side of said grading member;

a back side of said grading member coupled to and extending downwardly from a back edge of said top side of said grading member, said back side of said grading member comprising a plurality of teeth being evenly distributed between said first and second ends of said grading member;

a first lateral side of said grading member coupled to and extending downwardly from said first end of said grading member wherein said first lateral side of said grading member extends between said front and back sides of said grading member;

a second lateral side of said grading member coupled to and extending downwardly from said second end of said grading member wherein said second lateral side of said grading member extends between said front and back sides of said grading member;

an L-shaped bracket coupled to said grading member, said L-shaped bracket comprising a vertical portion of said L-shaped bracket being coupled to said front side of said grading member wherein a horizontal portion of said L-shaped bracket is spaced upwardly from said top side of said grading member wherein said horizontal portion of said L-shaped bracket extends toward said back side of said grading member;

a fastener extending through said vertical portion of said L-shaped bracket and engaging said front side of said grading member wherein said L-shaped bracket is retained on said grading member, said fastener being one of a pair of spaced fasteners;

said L-shaped bracket being one of a pair of said L-shaped brackets, each of said pair of L-shaped brackets being positioned proximate an associated one of said first and second ends of said grading member; and a front edge of a bucket on the vehicle being selectively positionable between said horizontal portion of said pair of said L-shaped brackets and said top side of said grading member wherein said grading member is coupled to the bucket on the vehicle, said grading member being urged along Earth wherein said front side of said grading member abrades Earth wherein said grading member is configured to level Earth.

* * * * *